US005878722A

United States Patent [19]

Gras et al.

[11] Patent Number: 5,878,722

[45] **Date of Patent: *Mar. 9, 1999**

[54] METHOD AND DEVICE FOR CONTROLLING AN ELECTROMAGNETIC LOAD

[75] Inventors: Jürgen Gras, Bietigheim-Bissingen; Hans-Peter Ströbele, Stuttgart; Rainer Kienzler, Reutlingen; Alfred Konrad, Strullendorf; Wolfgang Schmauder, Engstingen; Volker Gandert, Esthal; Matthias Kretzschmar, Vaihingen; Franz Thömmes, Farmington Hills, all of Germany

[73] Assignee: Robert Bosch GmbH, Stuttgart, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 765,007

[22] PCT Filed: Apr. 12, 1996

[86] PCT No.: PCT/DE96/00642

§ 371 Date: Mar. 27, 1997

§ 102(e) Date: Mar. 27, 1997

[87] PCT Pub. No.: WO96/32580

PCT Pub. Date: Oct. 17, 1996

[30] Foreign Application Priority Data

Mar. 12, 1995 [DE] Germany ..... 195 13 878.3

[51] Int. Cl.[6] ..... F02M 37/04

[52] U.S. Cl. ..... 123/506; 251/129.15

[58] Field of Search ..... 123/494, 506, 123/458, 500, 501; 251/129.01, 129.15

[56] References Cited

U.S. PATENT DOCUMENTS

| | | | |
|---|---|---|---|
| 4,788,960 | 12/1988 | Oshizawa | 123/506 |
| 5,197,439 | 3/1993 | Gronenberg | 123/506 |
| 5,205,262 | 4/1993 | Anton | 123/506 |
| 5,277,163 | 1/1994 | Ohishi | 123/506 |
| 5,325,837 | 7/1994 | Laufer | 123/506 |
| 5,375,575 | 12/1994 | Ohishi | 123/506 |
| 5,533,477 | 7/1996 | Weigl | 123/506 |
| 5,645,097 | 7/1997 | Zechmann | 251/129.01 |
| 5,646,600 | 7/1997 | Abel-Malek | 251/129.15 |

FOREIGN PATENT DOCUMENTS 44 15 361 11/1995 Germany .

*Primary Examiner*—Carl S. Miller
*Attorney, Agent, or Firm*—Kenyon & Kenyon

[57] ABSTRACT

A method for driving an electromagnetic load, particularly a solenoid valve that influences the fuel quantity to be injected into an internal combustion engine, the duration of the driving of the solenoid valve being correctable by a delay time, characterized in that the delay time can be specified as a function of the instantaneous value of the current to the desired switch-off procedure.

15 Claims, 3 Drawing Sheets

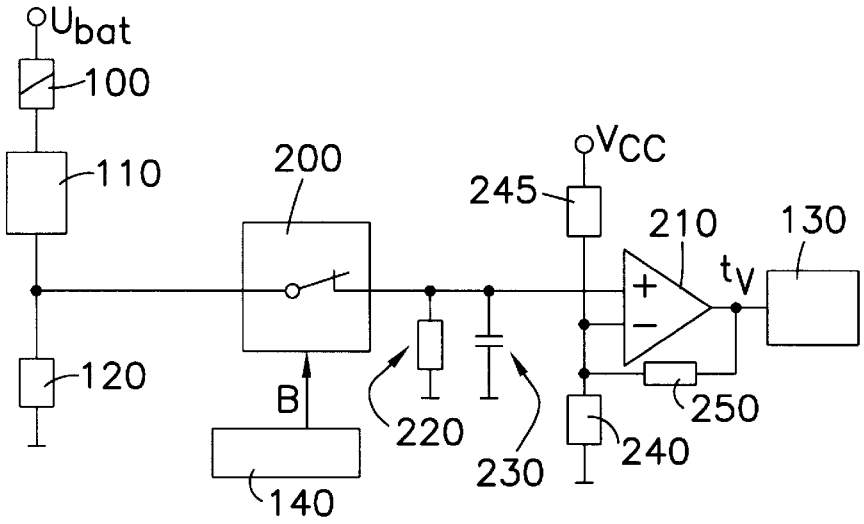
Fig. 2
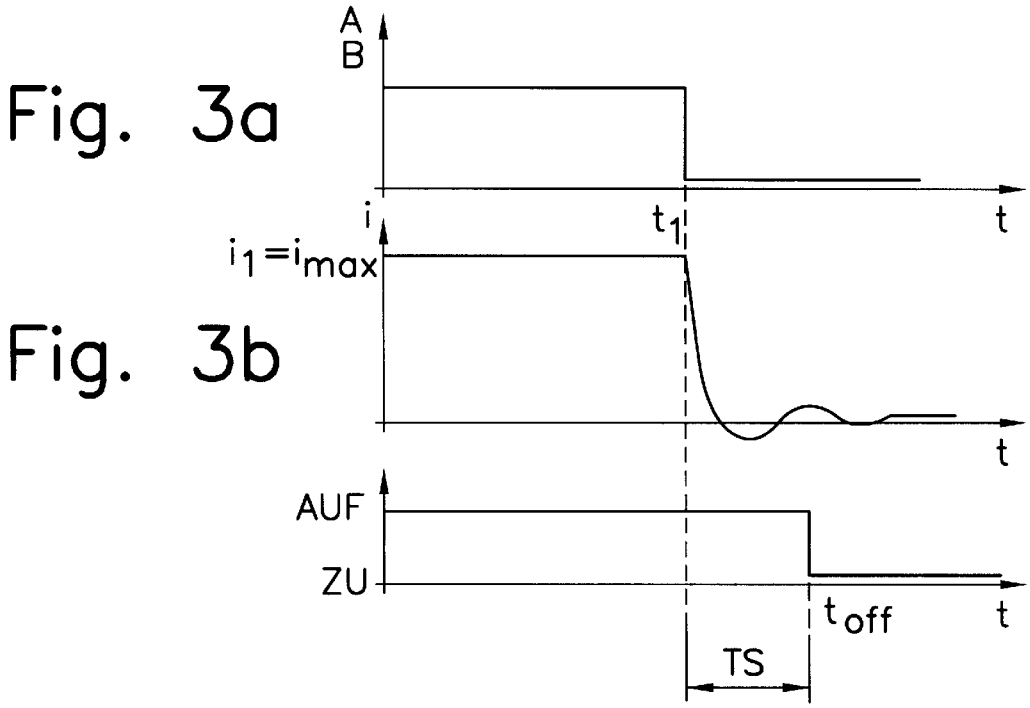
Fig. 3a
Fig. 3b
Fig. 3c

B
t

A
t1
t2
t
Δt

I
Imax
I1
t

AUF
ZU
toff
t
TS

METHOD AND DEVICE FOR CONTROLLING AN ELECTROMAGNETIC LOAD

BACKGROUND INFORMATION

The present invention concerns a method and an apparatus for controlling an electromagnetic load (device). From the German Patent Application No. DE-O 44 15 361, a method and an apparatus for controlling an electromagnetic load are known. Such electromagnetic loads are intended in particular to control the fuel metering in internal combustion engines. A solenoid valve establishes the injection duration in this process.

In solenoid valves, a certain time span normally passes between the drive time point and the reaction of the solenoid valve. This time span is normally known as the switching time of the valve. This switching time is a function of various parameters, such as the coil temperature and the current flowing through the coil. A variable switching time of the solenoid valve results in turn in a variable injection duration and thus in a changing injected fuel quantity.

SUMMARY OF THE INVENTION

The underlying object of the present invention is to increase the accuracy in a method and an apparatus for controlling the injected fuel quantity in an internal combustion engine.

With the method and the apparatus according to the present invention, the accuracy of the fuel metering can be significantly improved.

BRIEF DESCRIPTION OF THE DRAWINGS

FIG. 2 shows a detailed block diagram of an embodiment of the present invention.

FIG. 3*a* illustrates exemplary drive signals plotted over time according to an embodiment of the present invention.

FIG. 3*b* illustrates a first current signal plotted over time according to an embodiment of the present invention.

FIG. 3*c* illustrates the state of a solenoid valve plotted over time according to an embodiment of the present invention.

DETAILED DESCRIPTION OF THE INVENTION

The present invention is described hereafter based on the example of an apparatus for controlling the fuel quantity to be injected into an internal combustion engine. However, it is not restricted to this application. It can be used whenever the drive duration of an electromagnetic load (device) is to be controlled. This is particularly useful when the drive duration establishes a quantity such as the volumetric flow of a medium flowing through the solenoid valve.

Figure 1:
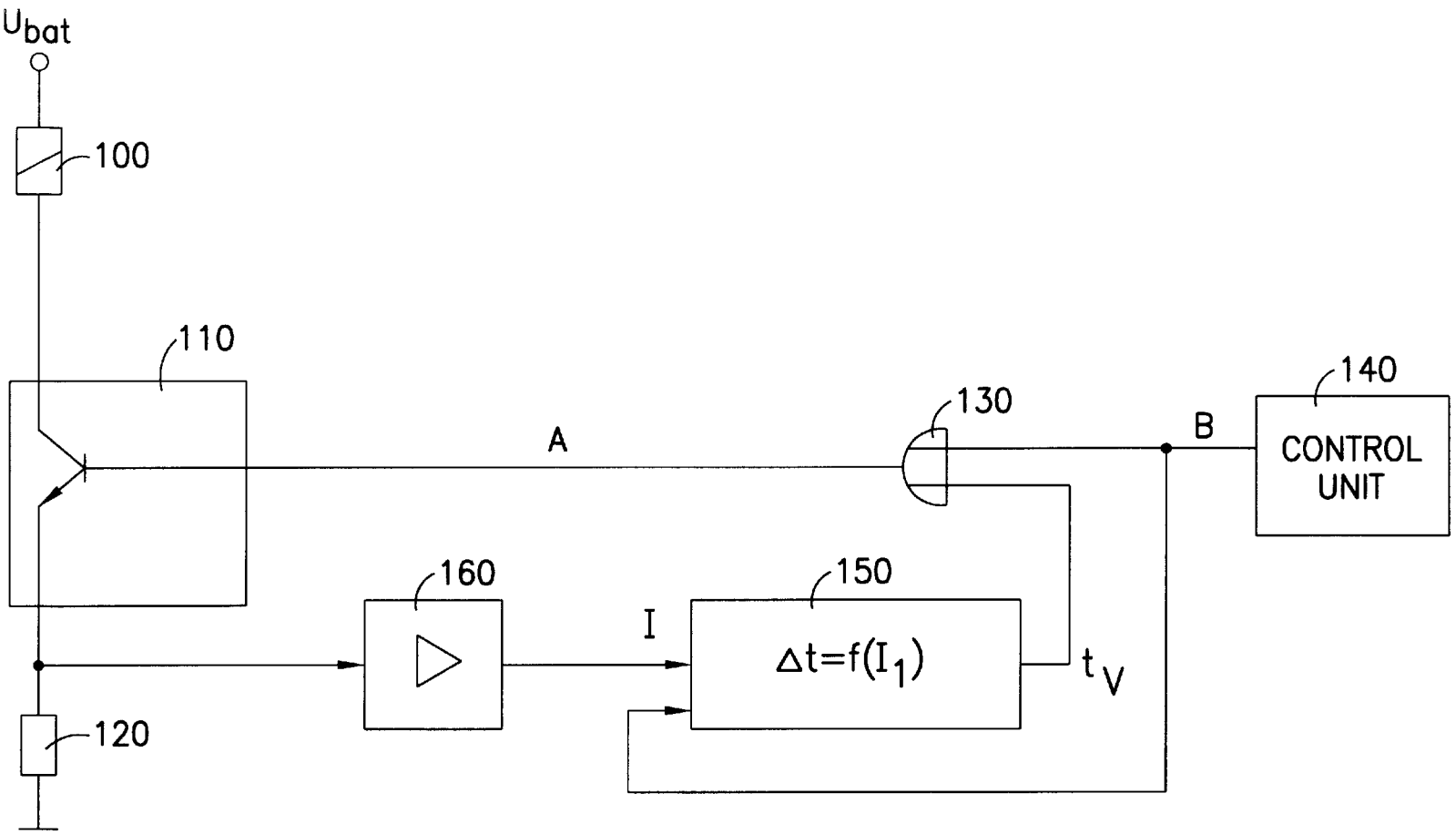
FIG. 1 shows a block diagram of the apparatus according to an embodiment of the present invention.

In FIG. 1, a solenoid valve is designated as 100. A first terminal of the coil of the solenoid valve 100 is connected to a supply voltage Ubat. A second terminal of the coil of the solenoid valve is connected to ground via a switching means 110 as well as a current-measuring means 120. The switching means is preferably realized as a transistor. The current-measuring means is preferably an ohmic resistance, the voltage drop across the ohmic resistance being evaluated for current measurement.

The switching means 110 has a drive signal A applied to it. As long as the drive signal A assumes a high level, the switching means 110 closes and thus enables the flow of current through the load. The drive signal A is provided by an OR element 130. The OR element 130 combines the output signal B of a control unit 140 and the output signal $t_v$ of a time extension unit 150. The output signal B of the control unit 140 and the output signal of a current determiner 160 are fed to the time extension unit 150. The current determiner 160 evaluates the voltage drop across the resistor 120.

The control unit 140 computes, based on signals not shown, a drive signal B for application to 110 enabling the flow of current through the load 100. After the current flows through the solenoid valve 100, the solenoid valve enables the fuel metering in the internal combustion engine.

If the signal B drops to its low level and there is no signal present from the time extension unit 150, the signal A likewise drops to the low level, which leads to an opening of the switching means 110 and to an interruption of the current flow. This results in the solenoid valve 100 closing again and the fuel metering ending.

The switch-off behavior of the solenoid valve 100 is determined substantially by the magnetic force at the time point of the switch-off. Various quantities have an influence on this magnetic force, including, for example, the voltage, tolerances of the inductance, and the coil resistance, as well as temperature influences. The switching time is essentially a function of the instantaneous current value I1 upon switch-off, i.e., when the signal A drops to low level. For large current values, longer switching times result than for small current values.

Usually, the current is not a constant quantity. The current is a function of, for example, the resistance of the coil and thus of the temperature of the coil. Moreover, current regulation can be provided in which the current fluctuates back and forth between two current values. With inductances, the current rises after switch-on according to an exponential function. The case can occur in which the time point at which the valve is switched off takes place at a time point where the current has not yet reached its final value. In these cases, the switching time deviates from its specified value.

According to the present invention, the current value I1 is measured at the time point of the switch-off time point T1 specified by the control unit, which switch-off time point corresponds to the end of the driving. As a function of this current value I1, the time extension unit 150 corrects the actual switch-off time point T2 so that a time arises as the effective drive duration of the solenoid valve which time results upon switch-off upon reaching the current final value $I_{max}$.

Based upon the current value I1 at the time point $t_1$, if the signal B drops to its low value, a correction time $\Delta t$ is determined as a function of the current value I1 at the switch-off time point. For this time duration $\Delta t$, the time extension unit 150 emits a signal $t_v$ having a high level. This results in the output signal A of the OR element 130 remaining at a high level for the time duration Δt and thus the drive duration of the solenoid valve being extended by this time Δt.

As an alternative to the current-measuring resistor 120, other methods can also be used to measure the current flowing through the load. For example, the use of a so-called sense-FET is also possible. This is a field-effect transistor that provides as an output quantity a partial current proportional to the current flowing through the load.

In FIG. 2, a possible specific embodiment of the time extension unit 150 is shown in greater detail. Elements already described in FIG. 1 are designated with corresponding reference signs. The voltage present on the current-measuring resistor 120 reaches an operational amplifier 210 via a switching means 200. The switching means 200 is switched as a function of the signal B of the control unit. Between the switching means 200 and the operational amplifier 210, a resistor 220 and a capacitor 230 are connected to ground. The second input of the operational amplifier 210 is connected to the center tap of a voltage divider including the resistors 240 and 245. The voltage divider including the resistors 240 and 245 is connected between ground and a voltage source VCC. The output of the operational amplifier 210 is fed back via a resistor 250 to its second input. At the output of the operational amplifier, the signal $t_v$ is present, which is fed to the OR element 130. As long as the signal B assumes a high level, the switch 200 is in its closed state. This results in the capacitor charging up on the voltage dropping across the resistor 120, which voltage is proportional to the current through the load. The output signal $t_v$ of the operational amplifier 210 assumes a high signal level here. If the signal B drops to its low signal level, the switch 200 opens and the capacitor 230 is discharged to ground via the resistor 220. As soon as the voltage present on the capacitor falls below a value specifiable by the voltage divider including the resistors 240 and 245, the operational amplifier switches through, which results in the output signal of the operational amplifier falling to 0. This switching causes the delay time by which the switch-on duration is extended to depend on the current value I1 which flows through the load 100.

In a further refinement according to the present invention, it is provided that the time extension unit 150 includes a characteristics map in which the relationship between the instantaneous value $I_1$ of the current at the time point $t_1$ of the drop of the signal B and the time span Δt by which the driving is extended is stored. Moreover, this quantity can be computed based on the current value $I_1$ according to a predetermined function $f(I_1)$. Here, the map or rather the function $f(I_1)$ is chosen such that for small current values $I_1$ a large time duration Δt results and for large current values $I_1$ a small time duration Δt results. The switching time TS of the valve is a function of the current $I_1$ that flows at the time point of the switch-off. This relationship can be determined through theoretical observations or through measurements. To each current value $I_1$ a correction value Δt can be assigned so that as a good approximation, the switching time is not a function of the current value $I_1$ and thus of fluctuations of the supply voltage, but is only now a function of the drive time.

In FIG. 3, the conditions are portrayed as are present if the switch-off, i.e., the drop of the signal B to a low signal level, takes place if the current through the load has reached its final value $I_{max}$. In FIG. 3*a,* the drive signal B and the drive signal A are plotted. In FIG. 3*b,* the current I that flows through the valve is plotted, and in FIG. 3*c* the state of the solenoid valve is plotted.

At the start, the drive signal B is at a high level, and the current I that flows through the solenoid valve assumes its maximum value $I_{max}$. The solenoid valve is in its opened position. At time point t1, the control unit 140 takes back (ends) the drive signal B. This causes the current I to drop to 0. The solenoid valve remains for a further time in its opened position. Not until a delay time to the time point $t_{off}$ elapses does the solenoid valve assume its new position and close. The delay time between the time point t1 and the time point $t_{off}$ is designated as switching time TS.

In FIG. 4, the conditions are portrayed for the case in which the switch-off occurs at a time point t1 at which the current value I1 at time point t1 has not yet reached the maximum value $I_{max}$. If, here, the switch-off occurs at the same time point, then the switching time is significantly shorter and the metering is correspondingly shortened, which results in a lesser fuel quantity.

Figures 4A, 4B, 4C, 4D:
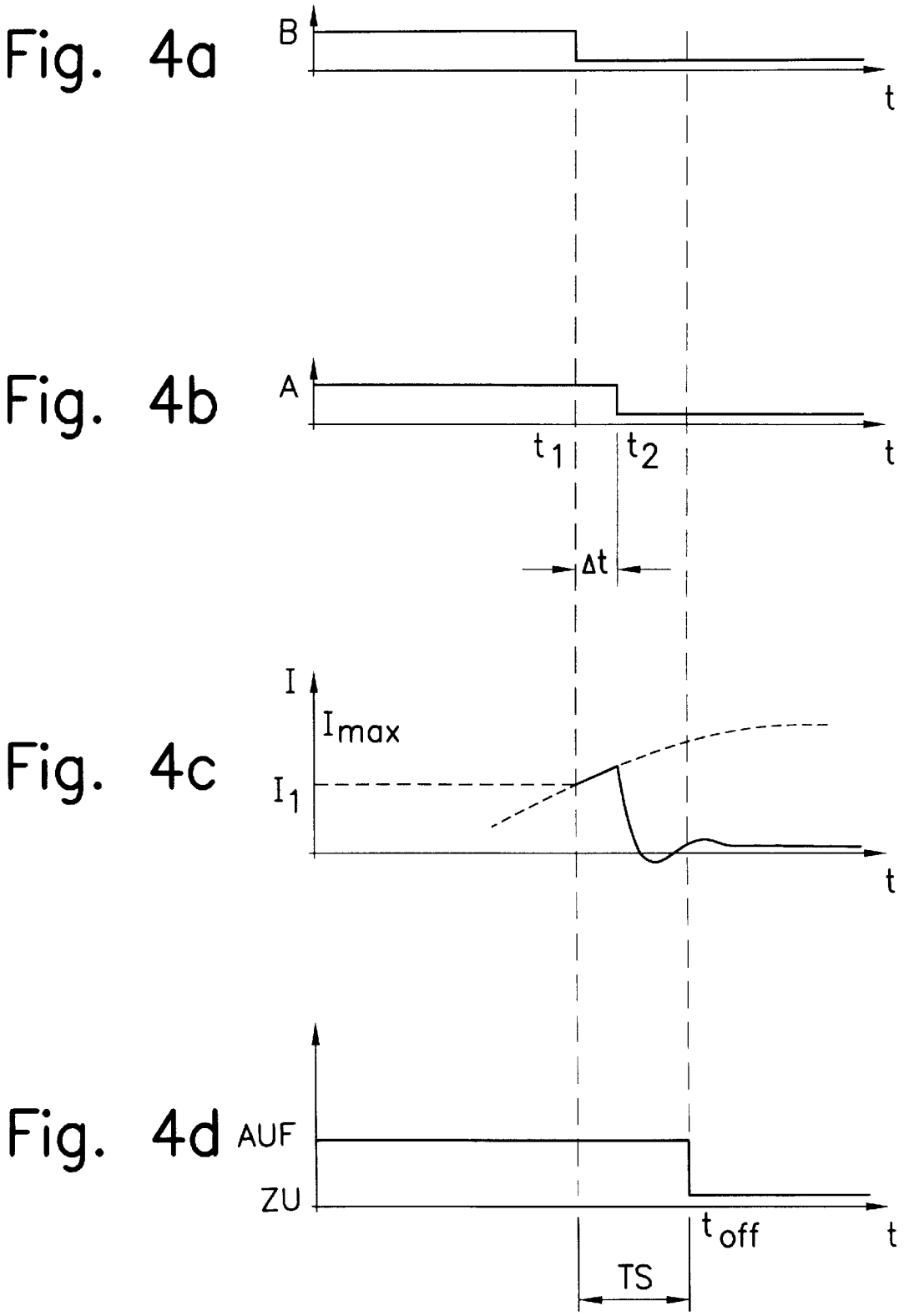
FIG. 4*a* illustrates a first drive signal plotted over time according to an embodiment of the present invention.
FIG. 4*b* illustrates a second drive signal plotted over time according to an embodiment of the present invention.
FIG. 4*c* illustrates a second current signal plotted over time according to an embodiment of the present invention.
FIG. 4*d* illustrates the state of a solenoid valve plotted over time according to an embodiment of the present invention.

In FIG. 4*a,* again the signal B of the control unit 140 is plotted, in FIG. 4*b* the signal A which is applied to the switching means 110 is plotted, in FIG. 4*c* the current I is plotted and in FIG. 4*d* the state of the solenoid valve is plotted. At the start, the signal A and the signal B assume their high level. This results in the solenoid valve being in its opened state. At time point $t_1$, the control unit 140 takes back the signal B from its high to its low signal level. The instantaneous current value I1 at the time point $t_1$ is smaller than the current value $I_{max}$. The result of this is that the switching time would be shorter than in the switch-off procedure shown in FIG. 3.

In order to correspondingly correct the drive duration, the time extension unit 150 generates a signal $t_v$ that is present for the time duration Δt. This causes in turn the output signal A which is applied to the switching means 110 to be present up to the time point $t_2$. This causes the current to rise further and not to drop until the time point $t_2$. The solenoid valve does not cut off the fuel flow until the time point $t_{off}$.

The signal $t_v$, or rather the delay time Δt, is stipulated such that the valve closes after the drop of the signal B after a fixed switching time TS elapses. Preferably, the switching time TS is determined at a specific current value $I_{max}$ and taken into account by the control unit in determining the signal B. In a refinement of the device according to the present invention, it can also be provided that the current value $I_{max}$ is any arbitrary current value. In order to achieve that the valve closes at the time point $t_{off}$, the control unit 140 emits a signal B that drops to its low level by the switching time TS before the time point $t_{off}$.

If the current value I1 which is present when the signal B drops to the value 0 deviates from the value $I_{max}$, the time extension unit 150 corrects the drive signal A by a time duration Δt that is a function of the current value I1 at the switch-off time point. Preferably, the time duration Δt is stipulated as a function of the difference between the current value I1 when the signal B drops and the current value $I_{max}$ at which the expected switching time TS was determined. If the two current values I1 and $I_{max}$ are the same, the time duration Δt goes to 0. If the current value I1 is smaller than the current value $I_{max}$ the driving is extended, the value Δt by which the driving is extended being greater for large deviations of the two values than for small deviations.

We claim:

1. A method for driving an electromagnetic load, comprising the steps of:

determining an instantaneous current value at a switch-off time point for a particular actuation of the electromagnetic load;

determining a desired delay time for the particular actuation of the electromagnetic load as a function of the instantaneous current value, wherein the desired delay time is determined during the particular actuation of the electromagnetic load; and controlling a duration of a driving time of the electromagnetic load for the particular actuation of the electromagnetic load as a function of the desired delay time.

2. The method according to claim 1, wherein the electromagnetic load includes a solenoid valve for influencing a fuel quantity to be injected into an internal combustion engine.

3. The method according to claim 1, further comprising the step of determining a difference between the instantaneous current value and a maximum current value, and wherein the step of determining the desired delay time further includes determining the desired delay time as a function of the difference.

4. The method according to claim 3, wherein the maximum current value corresponds to a desired switch-off time point.

5. The method according to claim 3, wherein when the instantaneous current value has a first current value, the desired delay time has a first time value, the first current value and the first time value having an inverse relationship.

6. The method according to claim 5, wherein when the instantaneous current value has a second current value, the desired delay time has a second time value, the second current value and the second time value having an inverse relationship, wherein the second current value is greater than the first current value and the second desired delay time is less than the first desired delay time.

7. The method according to claim 1, wherein the desired delay time is retrieved from a characteristics map in which delay times are stored as a function of the instantaneous current value.

8. An apparatus for driving an electromagnetic load, comprising:

a current measuring circuit determining an instantaneous current value at a switch-off time point of a particular actuation of the electromagnetic load; and an arrangement, connected to the current measuring circuit, for correcting a duration of a driving time of the particular actuation of the electromagnetic load as a function of a desired delay time, the desired delay time being determined during the particular actuation of the electromagnetic load as a function of the instantaneous current value.

9. The apparatus according to claim 8, wherein the electromagnetic load includes a solenoid valve for influencing a fuel quantity to be injected into an internal combustion engine.

10. A method for controlling an electromagnetic device including a solenoid valve, wherein a current runs through the solenoid valve when the solenoid valve is being driven, the driving of the solenoid valve having a duration and a switch-off time, the method comprising the steps of:

measuring an instantaneous value of the current at the switch-off time for a particular actuation of the solenoid valve;

computing a desired delay time for the particular actuation of the solenoid valve as a function of the instantaneous value, wherein the desired delay time is computed during the particular actuation of the solenoid valve; and adjusting the duration of the driving of the solenoid valve for the particular actuation of the solenoid valve as a function of the desired delay time.

11. The method of claim 10, further comprising the step of computing a difference between the instantaneous value of the solenoid current and a predetermined current value, and wherein the computing step computes the desired delay time as a further function of the difference.

12. The method of claim 11, wherein the predetermined current value corresponds to a predetermined switch off time of the solenoid valve.

13. The method of claim 11, wherein the desired delay time is retrieved from a characteristics map in which delay times are stored as a function of the instantaneous current value.

14. The method according to claim 1, wherein the step of determining the instantaneous current value includes the substep of:

measuring the instantaneous current value.

15. The apparatus according to claim 14, wherein the current measuring circuit measures the instantaneous current value.

* * * * *

UNITED STATES PATENT AND TRADEMARK OFFICE

CERTIFICATE OF CORRECTION

PATENT NO. : 5,878,722
DATED : March 9, 1999
INVENTOR(S) : Jurgen Gras et al.

It is certified that error appears in the above-identified patent and that said Letters Patent is hereby corrected as shown below:

Title page, Abstract [57],
Line 1, after "load" insert -- (device) --;
Line 2, "influences" should be -- meters --;
Line 4, "being" should be -- is ;
Line 5, delete "characterized in that" and insert -- wherein --;
Lines 6-7, delete "to the desired switch off procedure" and insert -- at the time the value is switched --;

Column 3,
Line 43, after "extension" insert -- device --.

Signed and Sealed this

Twenty-first Day of August, 2001

*Attest:*

Nicholas P. Godici

NICHOLAS P. GODICI
*Acting Director of the United States Patent and Trademark Office*

*Attesting Officer*